US005342000A

United States Patent [19]

Berges et al.

[11] Patent Number: 5,342,000

[45] Date of Patent: Aug. 30, 1994

[54] STRAND BRAKING APPARATUS

[75] Inventors: Dietrich Berges, Marienheide; Robert Führer; Harald Lentz, both of Remscheid, all of Fed. Rep. of Germany

[73] Assignee: Barmag AG, Remscheid, Fed. Rep. of Germany

[21] Appl. No.: 647,806

[22] Filed: Jan. 30, 1991

[30] Foreign Application Priority Data

Feb. 2, 1990 [DE] Fed. Rep. of Germany ..... 4003086
Jun. 20, 1990 [DE] Fed. Rep. of Germany ..... 4019585
Dec. 17, 1990 [DE] Fed. Rep. of Germany ..... 4005073

[51] Int. Cl.[5] ..... B65H 59/16; B65H 59/04; B65H 59/06

[52] U.S. Cl. ..... 242/155 M

[58] Field of Search ..... 242/156, 156.2, 155 M, 242/155 R, 45

[56] References Cited

U.S. PATENT DOCUMENTS 2,519,882 8/1950 Bullard et al. ..... 242/155 M
2,705,362 4/1955 Roughsedge ..... 242/155 M
2,839,697 6/1958 Pierce et al. ..... 242/155 M
3,042,327 7/1962 Henry ..... 242/156.2
3,259,336 7/1966 Hibbard ..... 242/155 M
3,830,050 8/1974 Ueda .
3,981,131 9/1976 Hartig et al. .
4,002,015 1/1977 Berges et al. .
4,200,212 4/1980 Hartig et al. .
4,516,739 5/1985 Wyatt .

FOREIGN PATENT DOCUMENTS 2808470 8/1979 Fed. Rep. of Germany .
2848384 5/1980 Fed. Rep. of Germany .
3531680 4/1986 Fed. Rep. of Germany .
4005739 9/1990 Fed. Rep. of Germany .
545743 2/1974 Switzerland .
2117015 10/1983 United Kingdom .
2137237 10/1984 United Kingdom .

OTHER PUBLICATIONS

Von Kurt Brinkmann; "Draht Fachzeitschrift"; Feb., 1962; pp. 53–59.

*Primary Examiner*—Stanley N. Gilreath
*Attorney, Agent, or Firm*—Bell, Seltzer, Park & Gibson

[57] ABSTRACT

An apparatus for imparting a braking force to an advancing strand is disclosed, and which includes a mechanical compensating arm brake followed in series by a movement dependent brake. The movement dependent brake may take any one of several forms, including an eddy-current brake which is directly connected to a roll which is driven by the strand, a hysteresis brake which is directly connected to a roll which is driven by the strand, or a brake of any type which is connected to a roll which is driven by the strand via a clutch, such as a centrifugal clutch, which is operated as a function of the speed of the movement of the strand.

13 Claims, 4 Drawing Sheets

STRAND BRAKING APPARATUS

BACKGROUND OF THE INVENTION

The present invention relates to an apparatus for imparting a braking force to an advancing strand. In the present application, the term "strand" is intended to encompass all linear structures, such as wires, yarns, bands, ropes, and the like.

A strand brake is disclosed in U.S. Pat. No. 3,830,050, which relates to a wire stranding machine. The known brake is universally usable for the adjustment of the tension of a strand, and it is used in particular for the adjustment of the tension of wires, bands, yarns, etc., which are withdrawn from a freely rotatable supply spool with a brake. Such known brakes have the disadvantage that the braking effect and, thus, also the increase of the tension are dependent on the amount of the strand tension. Another disadvantage is that despite the regulation, the tension increases as the spool empties from the full to the empty condition, when the brake is operative on the spool. This increase of tension is larger, the greater the tension is.

Yet another disadvantage is that the brake is adjusted to a certain strand tension right from the beginning. Although this tension may be optimal for the stationary operation, it can nonetheless be too high for the threading of the strand and for the startup of the machine, and can lead to difficulties, in particular to strand breaks. This applies especially to the use of the strand brake in machines in which the strand which is restrained by the brake, passes subsequently through a balloon. In this instance, the strand forces which develop in the balloon will not suffice to overcome the braking forces, when the machine is started up.

It is an object of the present invention to provide a strand brake which operates such that, especially when the strand is withdrawn from a supply spool, the tension of the strand has a controlled, desired gradient, that is low in particular at a standstill and at a startup, and remains substantially constant in the stationary operation, and that possible changes are likewise independent of the amount of the strand tension.

SUMMARY OF THE INVENTION

The above and other objects and advantages of the present invention are achieved in the embodiments illustrated herein by the provision of a strand braking apparatus which comprises first braking means for imparting a braking force to the advancing strand which is controlled as a function of the tension of the advancing strand, and second braking means for imparting a braking force to the advancing strand which is controlled as a function of the movement of the advancing strand.

In the present invention, the first and second braking means are arranged in series along the path of the advancing strand. The first braking means comprises a device for monitoring the strand tension together with a brake which is controlled as a function of the strand tension. A frequently used braking means of this type is a so-called compensating arm brake. Such a brake allows the supply spool of the advancing strand to be braked by a spring force, and the spring force can be relieved as a function of the increasing strand tension which is measured by the compensating arm. More particularly, in the case of a compensating arm brake, the strand tension is controlled by a compensating arm, which is pivoted in one direction by gravity or the force of a spring and guides the yarn in a loop, the size of the loop being dependent on the tension of the strand. The position of the compensating arm in turn controls the braking force applied to the supply spool.

As to movement dependent brakes, electromagnetic brakes are especially suitable, such as, for example, an eddy-current brake. In an eddy-current brake, a magnet performs a movement relative to a soft-iron disc with a layer of an electric conductor. As a result eddy currents are induced in the layer of the electric conductor, thereby producing a movement dependent braking moment.

Eddy-current brakes for takeup devices are known, note Trade Journal "Draht" 1962, pp. 53–59. However, the present invention is concerned with effecting a combination of a mechanical and a movement dependent brake. Consequently, the produced strand tension is composed of two components. The mechanically produced component is preferably kept small in relation to the movement dependent components, and as a result, mechanical troubles, such as, for example, the decreasing diameter during the unwinding process, have only a slight effect on the overall strand tension. Essential is that at a speed which remains constant, the larger, movement dependent components should also remain constant. The overall change of the strand tension resulting from an interference is therefore small.

In one preferred embodiment, the second or movement dependent braking means comprises a roll about which the advancing strand is wound, and an eddy-current brake which comprises a stationary magnet and an electromagnetic disc which is connected to the roll and positioned adjacent the magnet. In this embodiment, it is also possible and advantageous at low strand speeds and/or high strand tensions, to connect the roll driven by the strand with the eddy-current disc via a drive mechanism, for example a belt drive with a step-down gear, so as to obtain a high rotational speed of the eddy-current disc and thus high braking forces. If only slight strand tensions are produced, an operative connection in the opposite sense, i.e. a step-up gear, may be provided.

In a further embodiment, the second or movement dependent brake may employ a hysteresis brake, which would offer the advantage of setting the torque of the mechanical compensating arm brake at a low level, so that only a very slight change of this braking torque occurs. The essential portion of the braking torque, however, is to be produced by the hysteresis brake and is, therefore, constant so that the change of the braking torque, which occurs on the compensating arm brake as the diameter of the spool changes, is slight in relation to the overall braking torque.

In the hysteresis brake, a magnet performs a movement relative to a magnetizable hysteresis material, whereby a constant remagnetization of the hysteresis material occurs. In this brake, a braking torque results only from the relative movement. Consequently, the hysteresis brake has the advantage that the "threading" of the strand, i.e., the pulling of the strand into the machine is to be carried out under very little tension of the strand, which is only applied by the compensating arm brake.

In comparison therewith, the eddy-current brake and the other, movement dependent brakes have the further advantage that the balloon tension in cabling, winding and twisting machines can be kept very low at low speeds, and increases only with the speed. This permits a balloon to be formed at low speeds, so that the friction of the strand on the deflecting guide members and thus also the wear on the deflecting guide members remain very small. As a result, it is possible to adapt the braking effect to the speed and to the speed-dependent balloon tension of the strand.

However, a disadvantage of the above described, movement dependent brakes, in particular the eddy-current brake, is that the braking force is not upwardly limited. Consequently, the braking force is also dependent on the operating speed. It is possible, though, to make a compensation by the adjustment of the gap between the primary and the secondary portion of the eddy-current brake. However, another object of the present invention is to limit the braking force during a standstill and additionally also at the startup, but to keep it otherwise constant irrespective of the operating speed. Primarily, it is intended to facilitate threading and to adapt the strand tension to the growth of the balloon which occurs with the startup of the machine.

To achieve the above noted object, the present invention may further include a speed controlled clutch, by which the second braking means is engaged. In this embodiment, the second braking means is composed of two brakes, which are successively arranged. On the one hand, there is the brake clutch, which is speed-dependent. This function can be advantageously performed, for example, by a centrifugal clutch. On the other hand, there is a further brake attached to the non-drive end of the brake clutch. This further brake may be dependent on movement (for example, a hysteresis brake), on speed (for example, an eddy-current brake), or be independent (for example a mechanical or frictional brake). A braking of the non-drive end of the speed-dependent brake clutch by a hysteresis brake has the advantage that the hysteresis brake is free of wear, and otherwise dependent on movement, but substantially independent of speed. The adjustment of the speed-dependent brake clutch allows in this embodiment to set any desired, optimal transition between a lower level of the strand tension, which exists at a standstill, and an upper level of the strand tension, which exists during a continuous operation.

To avoid a mutual influence of the two braking means, it is preferred that the second braking means be arranged, when viewed in the path of the strand, downstream of the measuring point for the strand tension of the first braking means.

BRIEF DESCRIPTION OF THE DRAWINGS

Some of the objects and advantages of the present invention having been stated, others will appear as the description proceeds, when taken in conjunction with the accompanying drawings, in which FIG. 1 a schematic view of an apparatus for imparting a braking force to an advancing strand in accordance with the present invention, and which comprises a compensating arm brake and a movement dependent brake.

DETAILED DESCRIPTION OF THE PREFERRED EMBODIMENTS

Figure 1:
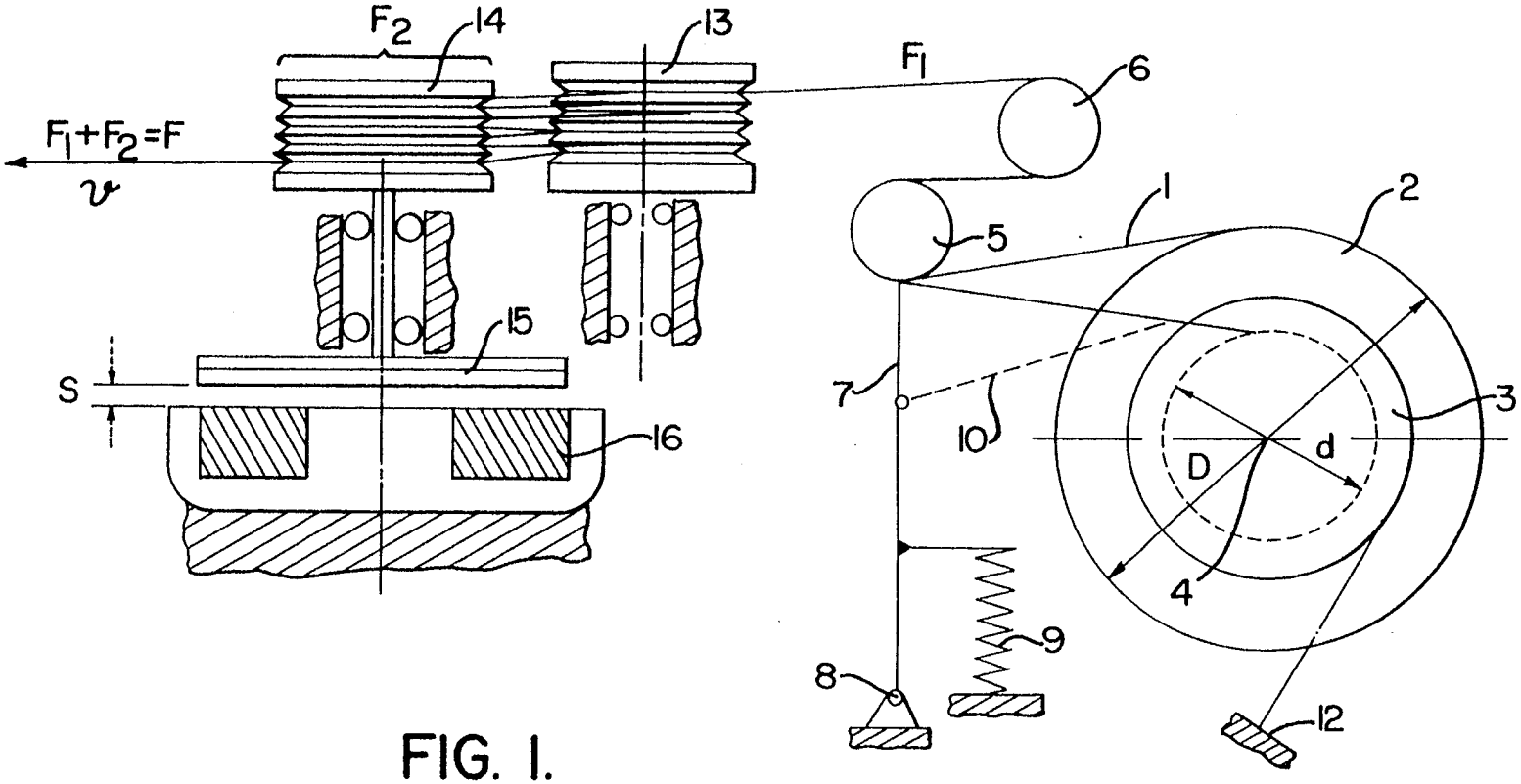
Figure 4:
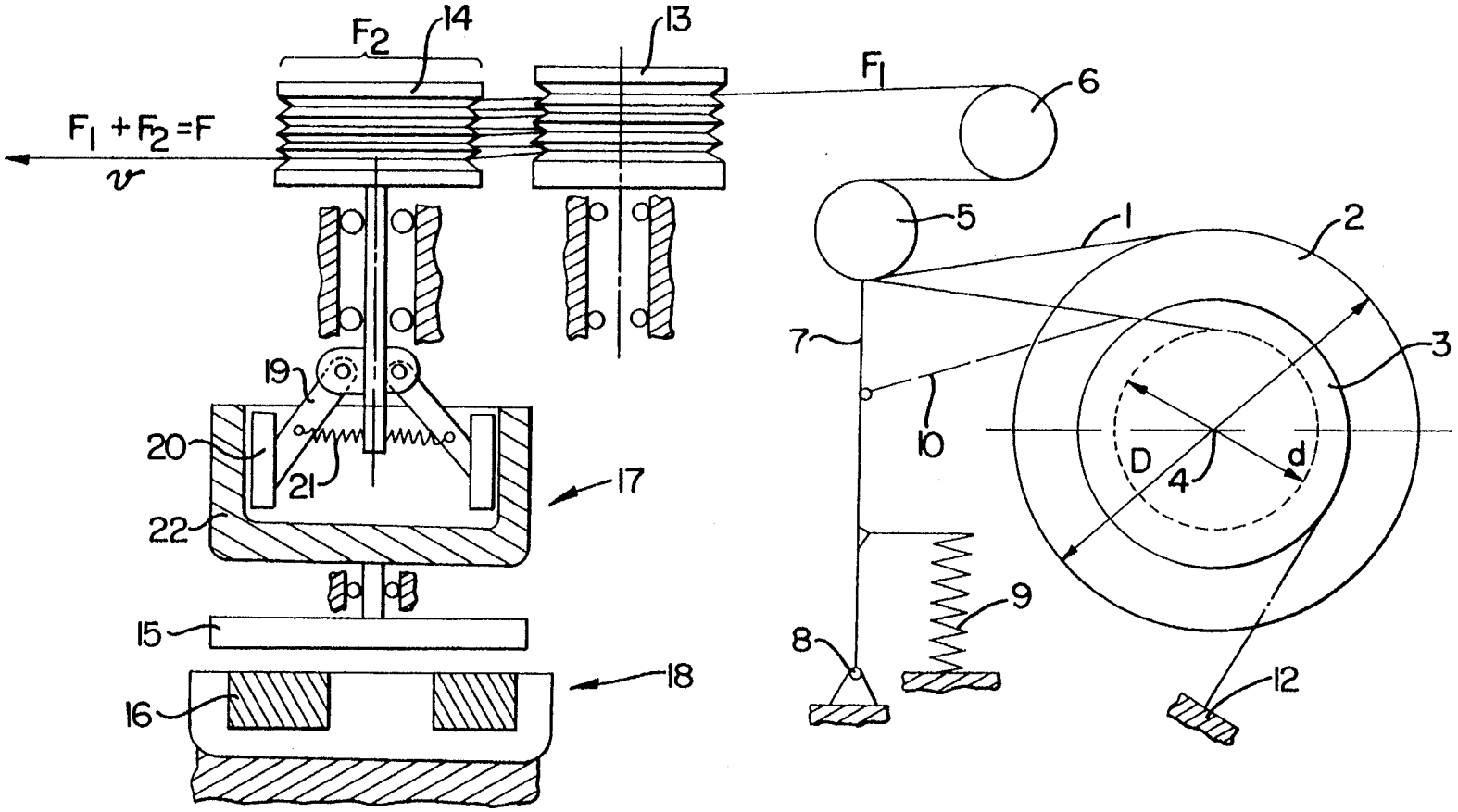
FIG. 4 is a schematic view of a second embodiment of the invention, and which comprises a compensating arm brake and movement dependent combination of a brake clutch and a hysteresis brake.

In the embodiments of FIGS. 1 and 4, the strand 1 is withdrawn from a supply spool 2, for example, by a twisting, cabling, processing or rewinding mechanism at a constant speed v. The supply spool 2 is mounted on a shaft 4, which is supported for free rotation, and which is provided with a brake. To this end, the supply spool 2 is firmly connected with a brake disk 3. The brake disk 3 is partially looped by a brake band 10, which is stationarily attached at point 12 and connected at its other end to a compensating arm 7. The compensating arm 7 is a lever which is pivotally connected at a single pivot 8. At its free end, the compensating arm 7 mounts a roll 5, which is partially looped by the strand as it is withdrawn from the supply spool 2. The compensating arm 7 is pivoted by a compression spring 9 to the left (counterclockwise) as seen in FIG. 1, so that the brake band 10 is tensioned.

Arranged in the path of the strand downstream of the compensating arm roll 5 is a deflecting roll 6. The deflecting roll 6 is followed by another pair of stationary rolls, comprising a deflecting roll 13 and a measuring roll 14. The strand loops about both of the rolls 13, 14 several times. The deflecting roll 13 and measuring roll 14 are supported for free rotation. In the embodiment of FIG. 1, the mounting shaft of the measuring roll 14 is fixedly connected to a metal disc 15, which is designed as an electromagnetic disc. It is also possible to connect the electromagnetic disc 15 with the measuring roll 14 via a drive mechanism with a step-up or a step-down gear. Opposite to the electromagnetic disk 15 is the face of a magnet 16. Left between the two is a small gap with a width S, which is preferably adjustable so that the magnet 16 is displaceable in the direction toward the electromagnetic disc 15.

During startup, the full supply spool has an initial diameter D, and the diameter decreases to a diameter d as the strand is withdrawn. The strand advancing from the supply spool loops about the compensating arm roll 5 and the deflecting roll 6 respectively at about 180°, so that it is guided in this region in the shape of an S or a Z. The compensating arm roll 5 moves substantially parallel between the strand segment advancing to it and the strand segment leaving it. Downstream of the deflecting roll 6, the strand loops several times about both the deflecting roll 13 and the measuring roll 14.

Figure 3:
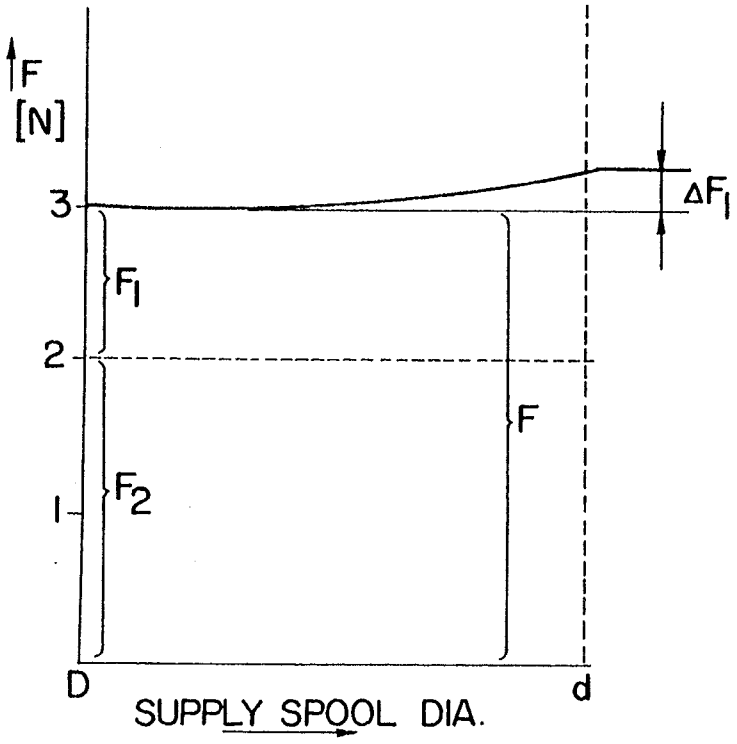
FIGS. 2–3, are diagrams showing the variation of the strand tension over the diameter of the supply spool.

In operation, the strand 1 drives the electromagnetic disc 15 at a constant speed. As a result, eddy currents are generated in the disc, and a braking moment is produced, which causes a tension or force F2 on the strand. This tension F2 is plotted in the diagram of FIG. 3. The force of spring 9 further causes a tension of force F1 on the strand respectively in the strand segment advancing to the compensating arm roll 5 and in the strand segment leaving such roll. When the strand tension decreases, the force of spring 9 pivots the compensating arm so as to increase the strand loop, which is formed between the supply spool 2 and the stationary deflecting roll 6. As a result, the brake band 10 is simultaneously tensioned to result in an increased braking of the supply spool 2, with the consequence that a tendency to an increase of the strand tension develops. The process is reversed when the strand tension increases. It is obvious that the torque exerted by the tension F1 on the supply spool is dependent on the diameter of the latter. Consequently, the tension necessary to overcome a predetermined braking moment is smaller at a large diameter D of the supply spool than at a small diameter d. This means that in the course of the unwinding cycle a change of the tension delta F1 occurs, which is plotted in the diagram shown in FIG. 3. As can further be seen in FIG. 3, the overall tension F=F1+F2 at the outlet of the brake is composed of a component F1, which is caused by the first, tension-dependent brake, and by the component F2 which is caused by the movement dependent brake. As can still further be noted from FIG. 3, this second component F2 is selected greater at a predetermined, constant strand speed than the first, tension-dependent component F1. Consequently, the change delta F1 of this component is likewise slight in relation to the overall strand tension.

Figure 2:
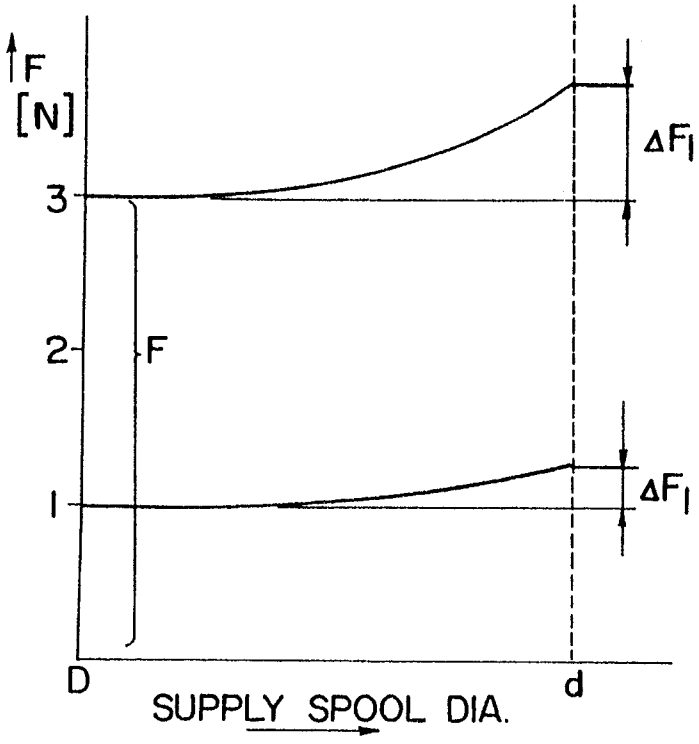

Illustrated in the diagram of FIG. 2 is the variation of the strand tension over the diameter for a compensating arm brake only. When supply spools with a low tension are processed, the amount of the diameter dependent increase delta F1 of the tension can be kept low. However, it is percentagewise large in comparison with the overall strand tension, namely just as large as in the case of a higher selected tension. In the case of a higher selected tension F1, however, a large absolute deviation delta F1 will result as the strand tension varies over the diameter of the spool.

In contrast thereto, the combined braking apparatus of the present invention has the advantage that the variation of the strand tension in the course of a winding cycle is small both as to the amount and as to the percentage.

When designed as a hysteresis brake, the electromagnetic disc 15 is replaced with a disc 15 of a material having a high magnetic retentivity, i.e. a hysteresis material, and which is magnetized by the stationary magnet 16, and which consequently opposes, due to the necessary remagnetization, the relative movement due to a braking movement which is substantially constant.

In the embodiment of FIG. 4, the measuring roll 14 is connected, via a speed-dependent brake clutch 17, with a further brake 18, which brakes the non-drive end of the brake clutch 17. Accordingly, the second braking means comprises the brake clutch 17 and the brake 18. The brake clutch is constructed as a centrifugal clutch. To this end, the shaft of the measuring roll 14 is provided with pivot levers 19, which are connected to the shaft and accommodate clutch shoes 20 at their free end. The pivot levers 19 are pulled radially inwardly by springs 21. The non-drive end of the brake clutch 17 is a rotatably supported cup 22 which surrounds the clutch shoes 20. In the present embodiment, the brake 18 is constructed as a hysteresis brake with a disc 15 of a hysteresis material and a stationary magnet 16.

In operation, the strand, which is withdrawn by means not shown, such as twisting device, as shown in DE-OS 35 31 680, is guided over the measuring roll 14 and drives the same. At a standstill and at very low speeds, the centrifugal clutch 17 does not engage. Consequently, the second braking device on the rolls 13 and 14 does not exert a braking force on the strand. The braking force is exerted only by the first braking device, and thus the strand tension can be very low.

Figure 5:
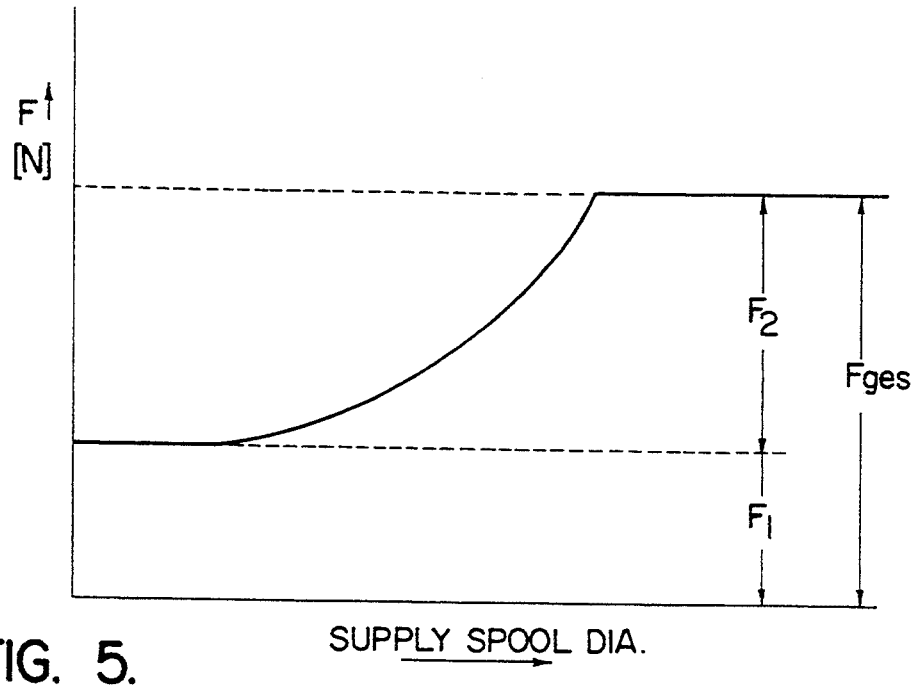
FIG. 5 is a diagram showing the variation of the strand tension during the startup.

As the speed increases, the brake clutch 17 engages. The braking torque exerted by the magnet 16 on the disc 15, however, is still greater than the torque transmitted by the clutch shoes 20 and the clutch cup 22. Consequently, a braking torque is transmitted on the measuring roll 14, which corresponds only to the torque transmitted by the brake clutch. This moment is speed-dependent and increases with the speed. Upon reaching a certain speed, which can be set by adjusting the centrifugal springs 21, the coupling torque on the non-drive end of the brake clutch 17 overcomes the braking torque exerted by the brake 18, with the consequence that now the torque on the measuring roll 14 corresponds to the torque exerted by brake 18. The variation of the strand tension, which is exerted in this manner at the startup of the machine, is represented in the diagram of FIG. 5. The design of the brake clutch 17 results in a substantial consistency of the variation of the tension and the strand tension, which is exerted by the ballooning strand as a function of speed.

Figure 6:
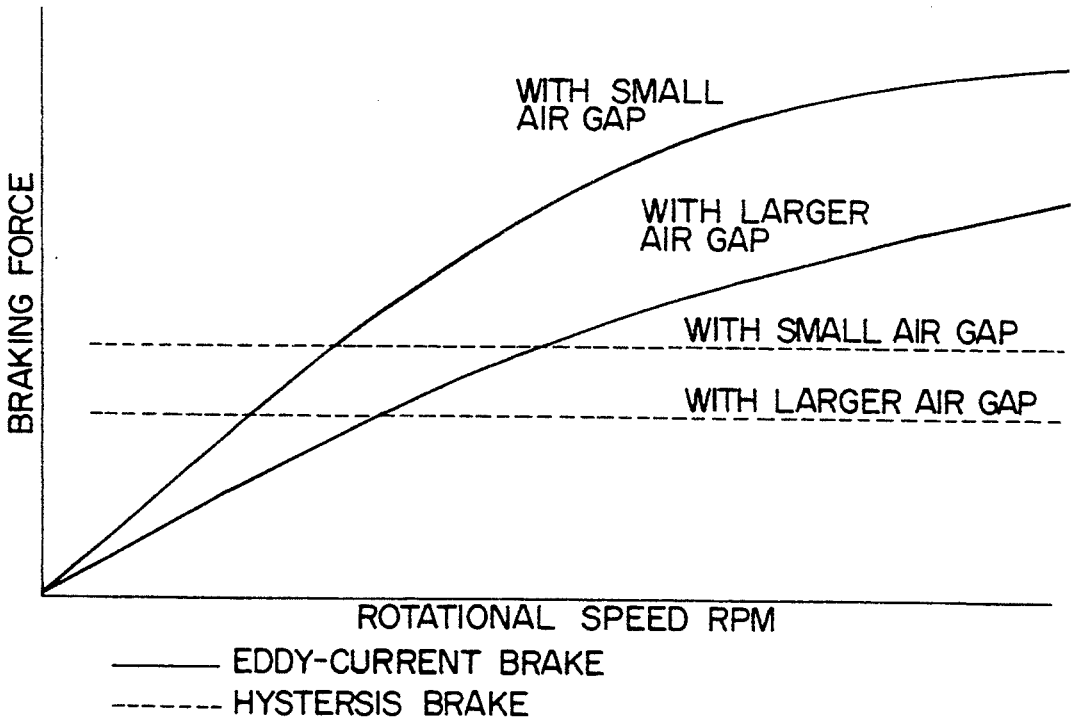
FIG. 6 is a diagram illustrating the relationship between rotational speed and braking force for an eddy-current brake and a hysteresis brake.

FIG. 6 of the drawings illustrate the known relationship between rotational speed and braking force for both an eddy-current brake and a hysteresis brake. As illustrated, the braking force of the eddy-current brake increases with the rotational speed, and with the force being smaller in the case of a large air gap between the cooperating surfaces. With respect to the hysteresis brake, the braking force depends only on the fact that there is relative movement between the cooperating surfaces and it is generally independent of rotational speed. Here again, the force is inversely related to the dimension of the air gap. This distinction is of importance since in a speed dependent brake the braking force is transformed into heat and the heat increases with speed, whereas in a brake which is independent of speed, the generation of heat is constant and can be kept at a low level.

In the drawings and specification, there has been set forth a preferred embodiment of the invention, and although specific terms are employed, they are used in a generic and descriptive sense only and not for purposes of limitation.

That which is claimed is:

1. An apparatus for imparting a braking force to an advancing strand and comprising first braking means for imparting a brake force to the advancing strand which is controlled as a function of the tension of the advancing strand, and magnetically actuated second braking means for imparting a braking force to the advancing strand which is controlled as a function to the movement of the advancing strand, said second braking means comprising a rotatable roll about which the advancing strand is adapted to be wound, a speed controlled clutch having a drive end connected to said roll and an opposite non-drive end, and a movement controlled braking means connected to the non-drive end of said clutch.

2. The apparatus as defined in claim 1 wherein said second braking means is positioned downstream of said first braking means when viewed in the direction of advance of the strand.

3. The apparatus as defined in claim 1 wherein said apparatus further comprises a rotatable supply spool for the advancing strand, and said first braking means comprises means for restraining rotation of said supply spool in response to the tension of the strand being withdrawn therefrom.

4. The apparatus as defined in claim 3 wherein said means for restraining rotation of said supply spool comprises a compensating arm pivotally mounted adjacent said supply spool and having a free end about which the advancing strand is adapted to advance and such that said arm tends to pivot in a predetermined direction when the tension of the advancing strand increases, biasing means for pivoting said arm in a direction opposite said predetermined direction, and band means operatively interconnecting said arm to said supply spool such that free rotation of said supply spool is increasingly restrained when said arm pivots in the direction opposite said predetermined direction.

5. The apparatus as defined in claim 1 wherein said movement controlled braking means comprises eddy-current brake means for imparting a braking resistance which is a function of the rotational speed of the roll.

6. The apparatus as defined in claim 1 wherein said movement controlled braking means comprises hysteresis brake means for imparting a braking resistance which is substantially independent of the rotational speed of said roll.

7. The apparatus as defined in claim 1 wherein said movement controlled braking means comprises mechanical brake means which includes two contacting surfaces which are in frictional engagement with each other.

8. The apparatus as defined in claim 1 wherein said speed controlled clutch comprises a centrifugal clutch.

9. An apparatus for imparting a braking force to an advancing strand and comprising a rotatable supply spool adapted to have the strand wound thereupon, first braking means for imparting a braking force to the advancing strand as it is unwound from said supply spool and which is controlled as a function of the tension of the advancing strand, and magnetically actuated second braking means positioned downstream of said first braking means for imparting a braking force to the advancing strand which is controlled as a function of the movement of the advancing strand, said second braking means comprising a roll about which the advancing strand is adapted to be wound, a speed controlled clutch having a drive end connected to said roll and an opposite non-drive end, and a movement controlled braking means connected to the non-drive end of said clutch.

10. The apparatus as defined in claim 9 wherein said speed controlled clutch includes means for controlling the operation of said clutch such that within a predetermined range of relatively low strand speeds the braking force exerted by said movement controlled braking means is greater than the torque transmitted by said speed controlled clutch, and such that the operative braking force comprises only that exerted by said clutch, and whereby above said predetermined range of strand speeds the operative braking force comprises that exerted by said movement controlled braking means.

11. The apparatus as defined in claim 9 wherein said first braking means comprises band brake means for restraining rotation of said supply spool as a function of the tension in the advancing strand.

12. An apparatus for imparting a braking force to an advancing strand and comprising first braking means for imparting a braking force to the advancing strand which is controlled as a function of the tension of the advancing strand, and second braking means for imparting a braking force to the advancing strand which is controlled as a function of the movement of the advancing strand, said second braking means comprising a rotatable roll about which the advancing strand is adapted to be wound, a speed controlled clutch having a drive end connected to said roll and an opposite non-drive end, and a movement controlled braking means connected to the non-drive end of said clutch.

13. An apparatus for imparting a braking force to an advancing strand and comprising a rotatable supply spool adapted to have the strand wound thereupon, first braking means for imparting a braking force to the advancing strand as it is unwound from said supply spool and which is controlled as a function of the tension of the advancing strand, and second braking means positioned downstream of said first braking means for imparting a braking force to the advancing strand which is controlled as a function of the movement of the advancing strand, said second braking means comprising a roll about which the advancing strand is adapted to be wound, a speed controlled clutch having a drive end connected to said roll and an opposite non-drive end, and a movement controlled braking means connected to the non-drive end of said clutch.

* * * * *